US006264770B1

(12) United States Patent
Hong et al.

(10) Patent No.: US 6,264,770 B1
(45) Date of Patent: Jul. 24, 2001

(54) INTERCRITICAL HEAT TREATMENT PROCESS FOR TOUGHNESS IMPROVEMENT OF SA 508 GR.3 STEEL

(75) Inventors: Jun Wha Hong; Hong Deuk Kim, both of Taejon-si; Yeon Sang Ahn, Choongcheongnam-do; Thak Sang Byun; Il Hiun Kuk, both of Taejon-si, all of (KR)

(73) Assignees: Korea Atomic Energy Research Inst., Taejeon-si; Korea Electric Power Corporation, Seoul, both of (KR)

( * ) Notice: Subject to any disclaimer, the term of this patent is extended or adjusted under 35 U.S.C. 154(b) by 0 days.

(21) Appl. No.: 09/131,892

(22) Filed: Aug. 10, 1998

(30) Foreign Application Priority Data

Oct. 21, 1997 (KR) ..... 97-54049

(51) Int. Cl.[7] ..... C21D 9/00; C21D 1/18; C21D 6/00

(52) U.S. Cl. ..... 148/663

(58) Field of Search ..... 148/663, 654, 148/660, 320

(56) References Cited

PUBLICATIONS

Forch et al, "Applications of Three–stage Heat Treatment to Thick–Walled Workpieces from Weldable, High Strength Fine Grained Structural Steels and Reactor Steels", Stahl u. Eisen 100 (1980) N.R.22, pp. 1329–1338.

Skamletz et al. "Advanced Technology of Heavy–Section Tube Sheets for Nuclear Power Generation", Steel Forgings, ASTM STP 903, pp. 410–424 Sep. 1986.

Haverkemp et al "Effect of Heat Treatment and Precipitation State on Toughness of Heavy Section Mn–Mo–Ni–Steel for Nuclear Power Plants Components", Nuclear Engineering and Design 81 (1984) pp. 207–217.

Nisbeitt, Factors Affecting the Notch Toughness of Carbon and Low–Alloy Steel Forgings for Pressure Vessel and Piping Application Transactions of the Asme, vol. 100, Oct. 1978, pp. 337–347.

"Specification for Quenched and Tempered Vacuum–Treated Carbon and Alloy Steel Forgings for Pressure Vessels", ASTM SA 508/SA–508M (1992), pp. 755–762.

"Standard Specification for Quenched and Tampered Vacuum–treated Carbon and Alloy Steel Forgings for Pressure Vessels", ASTM A 508/A M–95 (1995), pp. 1–6.

*Primary Examiner*—Deborah Yee
(74) *Attorney, Agent, or Firm*—Dilworth & Barrese, LLP

(57) ABSTRACT

The present invention relates to the heat treatment processes for manufacturing high toughness SA 508 Gr.3 steels including the intercritical heat treatment step in addition to the conventional heat treatment process, wherein the intercritical heat treatment(IHT) is added between the quenching step and the tempering step and is performed at 680° C. to 750° C., which is the ferrite/austenite two phase region, for 1 hour to 8 hours. When compared with the conventional heat treatment process the room temperature impact energy and the upper shelf energy of the steels manufactured by the invention increase significantly and the ductile-to-brittle transition temperature decreases. Also the present invention relates to the modified tempering processes for manufacturing high toughness SA 508 Gr.3 steels, wherein the tempering after the intercritical heat treatment is performed at the temperature lower than 635° C. The modified tempering is performed to compensate the decrease of strength due to the intercritical heat treatment and to additionally increase the toughness of the intercritically heat treated SA 508 Gr.3 steels.

16 Claims, 10 Drawing Sheets

INTERCRITICAL HEAT TREATMENT PROCESS FOR TOUGHNESS IMPROVEMENT OF SA 508 GR.3 STEEL

FIELD OF THE INVENTION

The present invention relates to the heat treatment processes for manufacturing high-toughness SA 508 Gr. 3 steels by adding the intercritical heat treatment between water quenching and tempering to the conventional quality heat treatment process. The intercritical heat treatment is performed in the ferrite(α)/austenite(γ) two phase region. The intercritical heat treatment increases the Charpy impact energy(CVN energy) and decreases ductile-to-brittle transition temperature(DBTT), as well as the ductility of the material.

The present invention also relates to the modification of tempering conditions to compensate the loss of strength due to the intercritical annealing and to additionally increase the toughness of the intercritically heat treated SA 508 Gr. 3 steels.

BACKGROUNDS OF THE INVENTION

The SA 508 Gr. 3 forged steels have been used for the reactor pressure vessels of pressurized light-water reactors and the pressurizer shells and steam generator shells of nuclear power plants.

The reactor pressure vessel materials need excellent properties such as high resistance against the embrittlement by fast neutron irradiation, high toughness, high fatigue life, high homogeneity, and good weldability because they are used for long terms over 40 years in the severe conditions of high temperature, high pressure and neutron irradiation.

Particularly, fast neutron irradiation in the belt-line region of reactor pressure vessel causes to decrease the upper shelf energy(USE) and to increase the ductile-to-brittle transition temperature(DBTT) during operating. This embrittlement phenomenon in the pressure vessel limits the operating conditions and the life of the power plant. Accordingly, it is preferable to manufacture the pressure vessel steels having high toughness in order to obtain the operating margins and to extend the life of the power plant.

Conventionally, the quality heat treatment, the heat treatment process after forging, of SA 508 Gr. 3 steel forgings is consisted of quenching, tempering and post-weld heat treatment, and the methods and the conditions of the heat treatment are specified in ASME/ASTM specification (ASME "Specification for Quenched and Tempered Vacuum-Treated Carbon and Alloy Steel Forgings for Pressure Vessels", ASME SA-508/SA-508M, 1995, pp. 785–792, ASTM "Standard Specification for Quenched and Tempered Vacuum-Treated Carbon and Alloy Steel Forgings for Pressure Vessels", ASTM A 508/A 508M-95, 1995, pp. 1–6).

The quenching treatment is to cool the material in water after annealing at a high temperature for austenitization. Therein the fine microstructure and high toughness of final product can be obtained by increasing the cooling rate and by optimizing the tempering condition.

However, the toughness of the pressure vessel steels can not be increased by a change in the conventional heat treatment processes because the pressure vessel is an extremely heavy component whose thickness usually reaches 10 inches or more, thus it is substantially impossible to increase the cooling rate up to over 30° C. per minute.

ASME/ASTM specifies that the tempering of the SA 508 Gr. 3 steel is performed at over 650° C. for over 30 minutes per one inch thickness of the vessel wall in order to obtain sufficient toughness; 10 inch wall needs a tempering for at least 5 hours.

As a complementary condition for the case that post-weld heat treatment is applied, ASME/ASTM specifies that the tempering can be performed at a temperature over 635° C. It is, in general, performed at over 650° C.

Meanwhile, the intercritical heat treatment(IHT) has been used in the processes for manufacturing dual-phase steel plates, especially for applications to automobile industry. High strength and ductility are obtained by dispersing the martensite phase, usually 5 to 40%, in ferrite matrix. The ferrite-martensite dual phase structure is obtained by the heat treatment process consisted of the intercritical annealing at the ferrite-austenite two phase region and quenching.

Recently, the intercritical heat treatment has been introduced to the manufacturing processes of the quenched and tempered steels such as 9Ni steels, rotor steels, pressure vessel steels, etc, to improve the toughness.

German Skamletz et al (T. A. Skamletz and W. W. Grimm, "Advanced Technology of Heavy-Section Tube Sheets for Nuclear Power Generation", Steel Forgings, ASTM STP 903, E. G. Nisbett and A. S. Melilli, Eds., American Society for Testing and Materials, Philadelphia, pp. 410–424, K. Forch, W. Witte, and S. H. Hattingen, "Application of Three-Stage Heat Treatment to Thick-Walled Workpieces from Weldable, High-Strength Fine-Grained Structural Steels and Reactor Steels", Stahl u. Eisen 100 (1980) 1329–1338, K. D. Haverkamp, K. Forch, K.-H. Piehl, and W. Witte, "Effect of Heat Treatment and Precipitation State on Toughness of Heavy Section Mn—Mo—Ni—Steel for Nuclear Power Plants Components", Nucl. Eng. & Design 81 (1984) 207–217) had reported that the three step heat treatment of DIN 20 Mn—Mo—Ni 55 steel, a similar steel to SA 508 Gr. 3 steel, including an additional annealing step at 750° C. to 770° C. between quenching and tempering can increase the impact energy and decrease the transition temperature. In their reports, however, the increase of impact energy has not been observed at the temperatures higher than room temperature Nisbett(E. G. Nisbett: J. Eng. Mater. Technol. (Trans ASME), 100 (1978) 338–347) had reported that when SA 508 Cl. 2 steel is treated with intercritical annealing at 790° C., the impact toughness value increases.

The ASME/ASTM specification(1995 edition) for SA 508 Gr. 3 steel forgings allows the re-austenitization treatment; an intercritical heat treatment can be performed by re-heating to the intercritical temperature region to partially reproduce austenite phase.

In order to improve the mechanical properties of the final product, it is important to optimize the volume fraction of austenite in the two phase region by controlling the temperature and time of the intercritical annealing.

However, the conditions of intercritical heat treatment are different from each other according to alloy systems; the condition for improving the impact properties of SA 508 Gr. 3 steels is not presented at the present time.

Under the above situation, we, the inventors of the present invention, have tried to establish the condition of intercritical heat treatment of SA 508 Gr. 3 steel in order to improve its toughness and have completed the present invention.

SUMMARY OF THE INVENTION

The purpose of the present invention is to provide processes for manufacturing high toughness SA 508 Gr. 3 steels by using intercritical heat treatment.

To achieve the above goal, the heat treatment process after forging has been improved by adding the intercritical heat treatment process to the conventional heat treatment process for SA 508 Gr. 3 steel. In this invention, the optimum intercritical heat treatment process for manufacturing high toughness SA 508 Gr. 3 steel is the annealing treatment at 680° C. to 750° C., which is ferrite-austenite two phase region, for 1 hour to 8 hours between quenching and tempering in the conventional quality heat treatment process.

Also, the present invention includes the tempering conditions modified to maximize the improvement of toughness and to minimize the decrease of strength.

[b] is the graph for the case that the cooling rate after the intercritical heat treatment is 20° C./min.

Figure 5A:
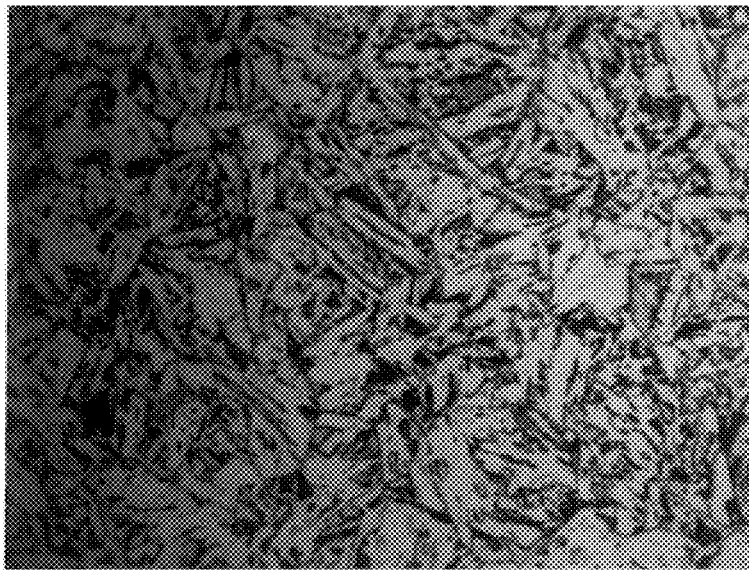
Figure 5B:
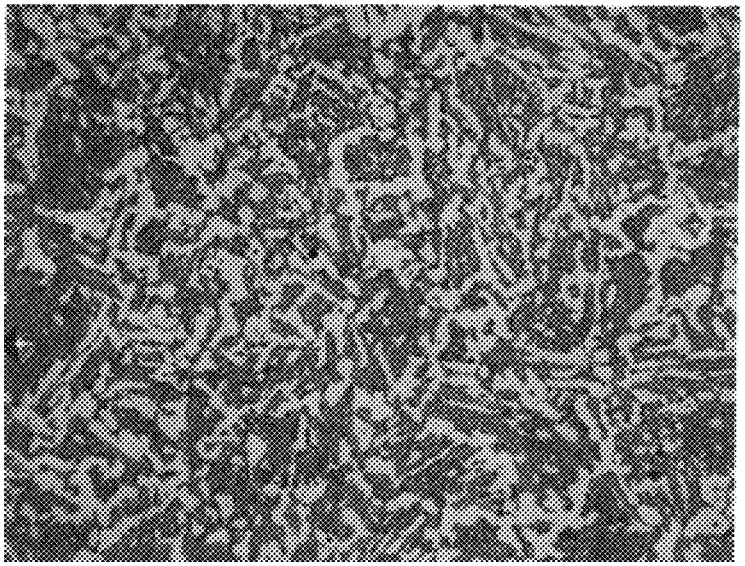
Figure 5C:
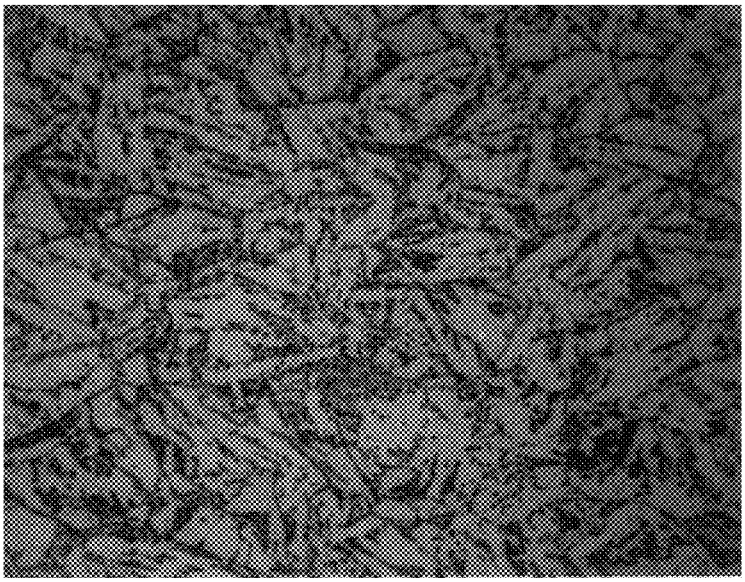
Figure 5D:
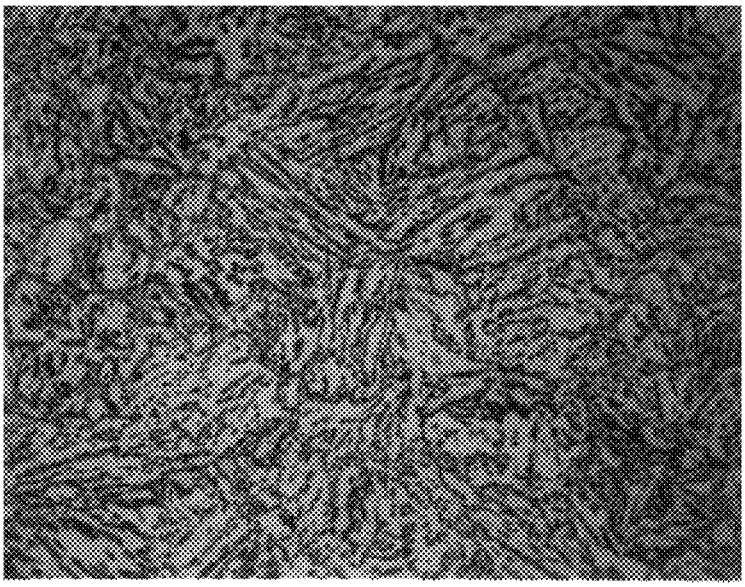

FIG. 5 is the optical micrograph showing the change of microstructure during the heat treatment, where FIG. 5*a* is the microstructure of quenched state, FIG. 5*b* is the microstructure of quenched and intercritically heat treated state, FIG. 5*c* is the microstructure of quenched and tempered state without intercritical heat treatment, and FIG. 5*d* is the microstructure of quenched, intercritically heat treated and tempered state (new heat treatment process 1).

Figure 6A:
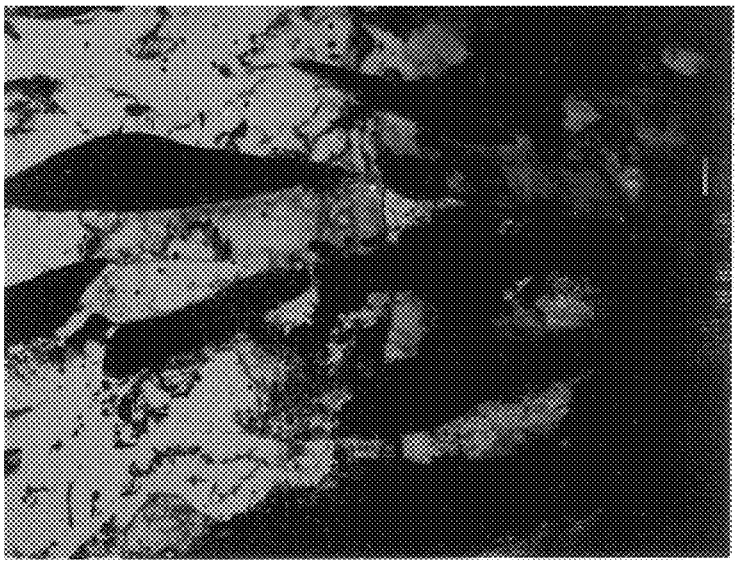
Figure 6B:
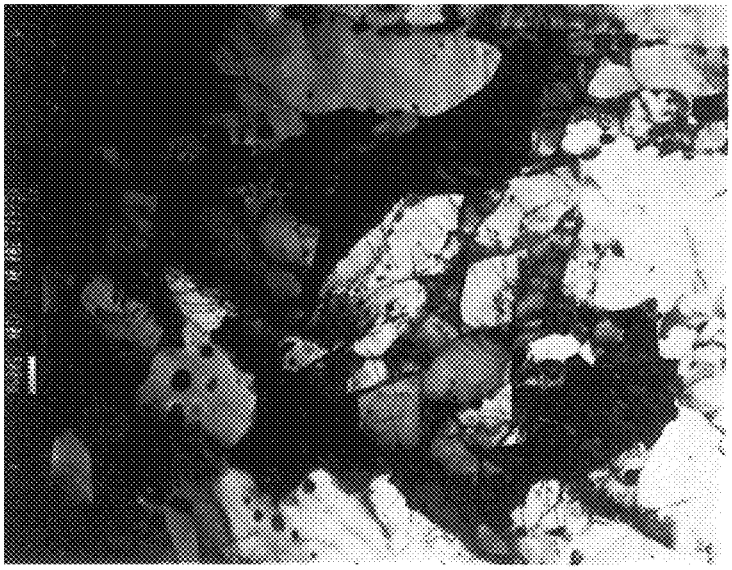

FIG. 6 is the transmission electron micrograph showing the effect of intercritical heat treatment, where FIG. 6*a* is the microstructure of quenched and intercritically heat treated state, and FIG. 6*b* is the microstructure of quenched, intercritically heat treated and tempered state(new heat treatment process 1).

Figure 7A:
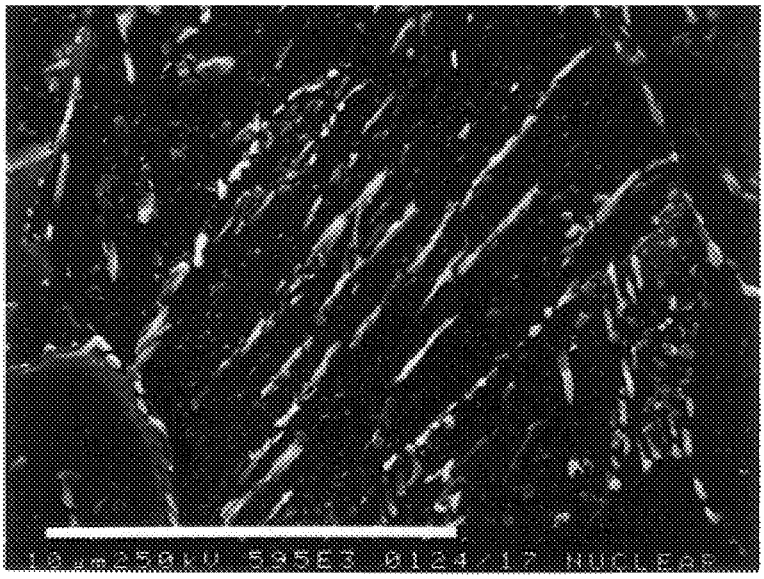
Figure 7B:
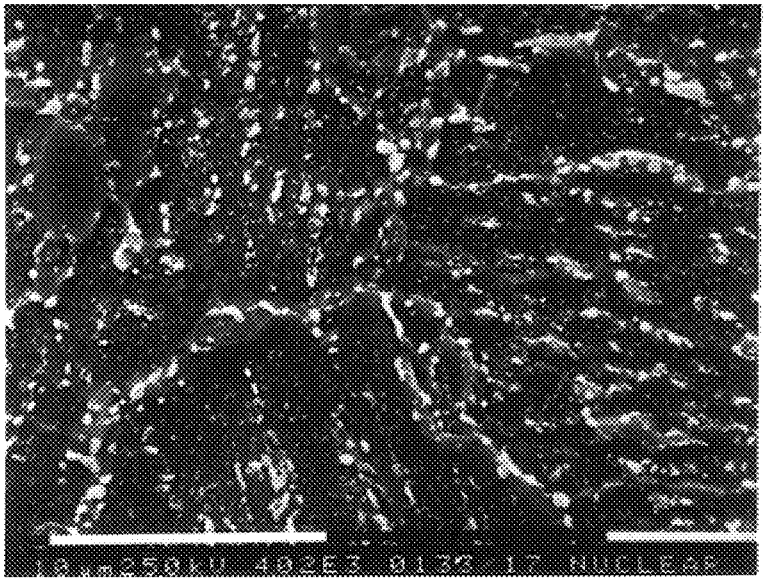

FIG. 7 is the scanning electron micrograph showing the effect of intercritical heat treatment, where FIG. 7*a* is the microstructure of quenched and tempered state, and FIG. 7*b* is the microstructure of quenched, intercritically heat treated and tempered state.

Figure 8:
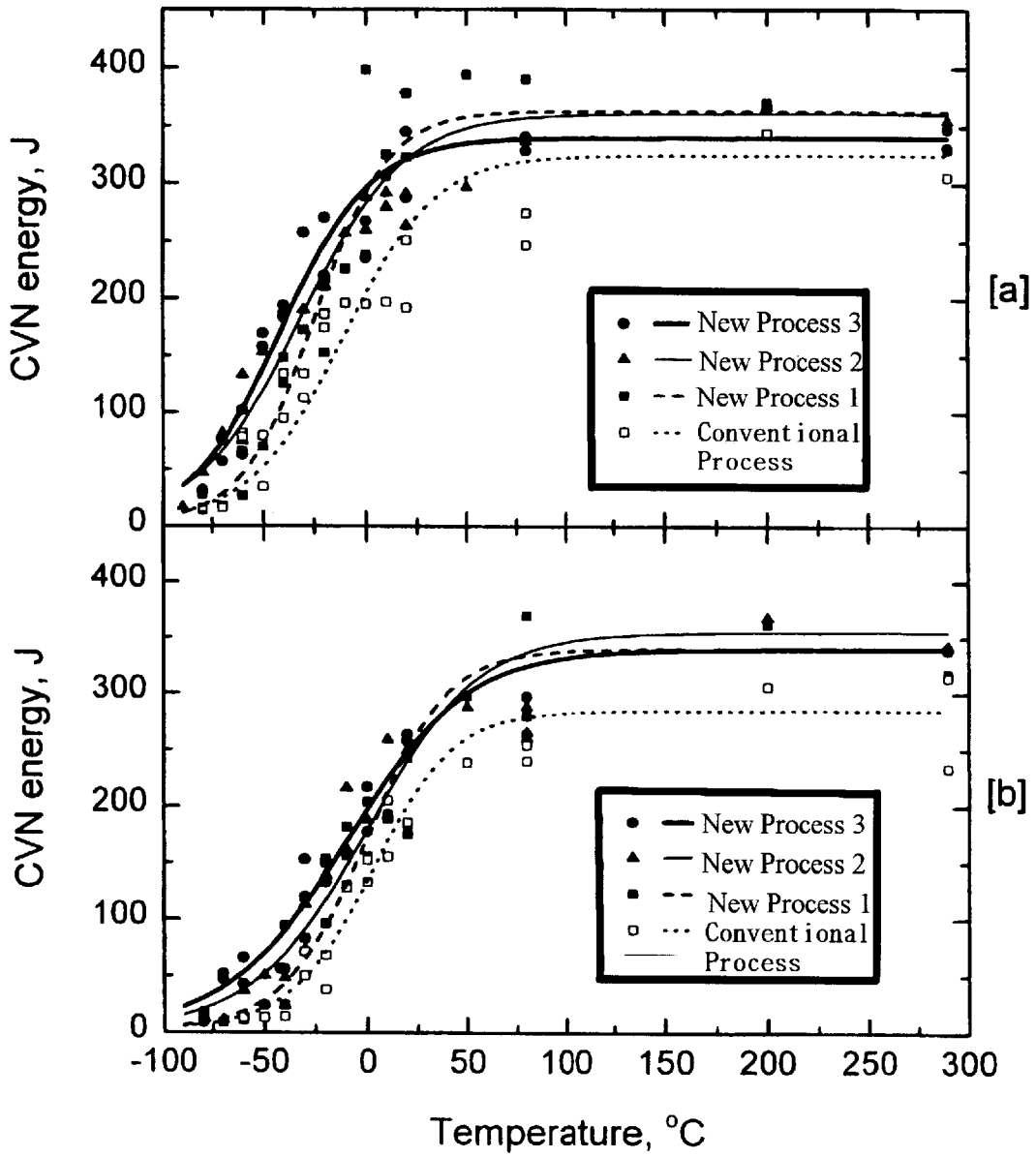

FIG. 8 is the graph showing the effect of tempering condition on the impact properties, where [a] is the graph in the case that the cooling rate after austenitization treatment and intercritical heat treatment is 100° C./min, and

[b] is the graph in the case that the cooling rate after austenitization treatment and intercritical heat treatment is 20° C./min.

Figure 9:
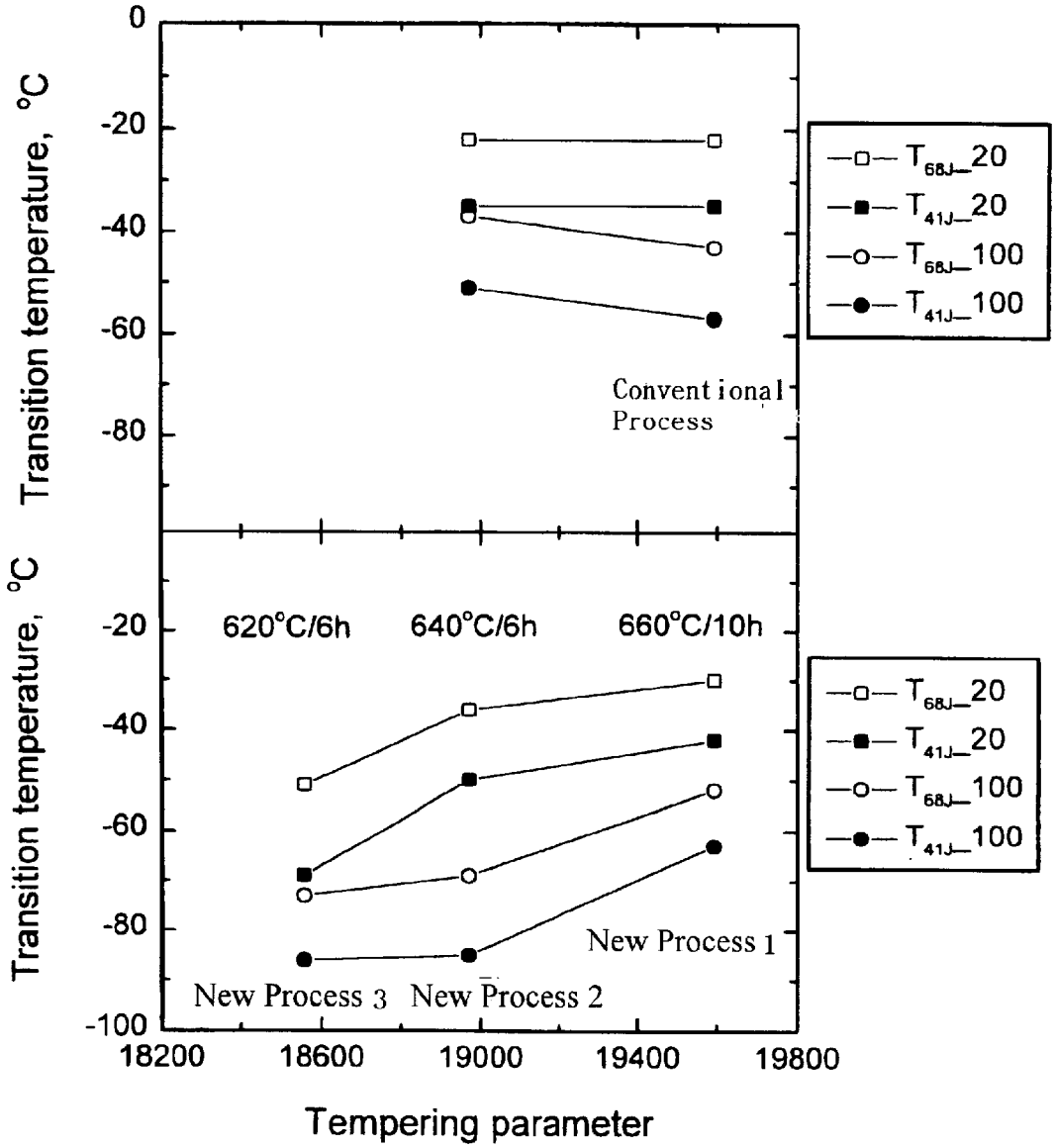

FIG. 9 is the graph showing the variations of transition temperature with tempering parameter.

DETAILED DESCRIPTION OF THE INVENTION

The intercritical heat treatment is performed after normalizing and quenching; the steel is annealed at the intercritical temperature region in which ferrite phase and austenite phase can exist. The volume fraction of austenite phase increases during annealing and eventually saturated at a volume fraction, which is determined by the composition of alloy elements and annealing temperature. The elements such as C, Mn, Ni, etc are concentrated on the austenite phase so that this phase reveals high hardenability during quenching. Especially, the carbon solubility is much higher in austenite phase than in ferrite and it diffuses fast at such a high temperature. The hardenability depends mainly on the carbon concentration of the austenite. This austenite transforms to martensite during quenching.

Accordingly, a proper intercritical heat treatment followed by water quenching brings about the martensite structure having high dislocation density and fine substructure after quenching, consequently we can obtain the same profitable effects as the effects from the increase of cooling rate.

Also, the tempering treatment after intercritical heat treatment followed by quenching produces a composite structure of relatively strong tempered martensite and softer matrix, mainly tempered bainite. The additional boundaries between these two phases as well as the refined lath structure of the tempered martensite will greatly decreases effective grain size. These boundaries can act as barriers to the growth of microcrack and consequently enhance the fracture toughness.

The structure of the steel obtained by intercritical heat treatment and the mechanical properties of the structure are dependent upon the amount of austenite which depends on the heating rate on heating to the two phase temperature region and on the intercritical annealing conditions; temperature and holding time. Lowering the heating rate on heating to intercritical temperatures, the transformation starting temperature(A1) decreases and the ferrite starts to transform to austenite at a lower temperature.

However, the amount of austenite phase is determined mainly by the intercrictical heat treatment conditions. Increasing the temperature and holding time in the intercrictical heat treatment, the amount of austenite increases.

When the intercritical annealing temperature is too high and the holding time is too long, the profitable effects from the intercritical heat treatment may disappear. This is because the amount of austenite phase excesses an optimum volume fraction so that the carbon concentration and hardenability of austenite phase decrease.

Accordingly, to obtain a high toughness SA 508 Gr.3 steels, it is important to optimize the volume fraction of austenite by controlling the heating rate, annealing temperature and holding time in the intercritical heat treatment process.

However, the condition of intercritical heat treatment is different from each other according to alloy system, so the condition should be decided by experiment.

The present invention establishes the conditions for intercritical heat treatment capable of increasing eminently impact energy of the SA 508 Gr.3 steels and also establishes the modified conditions for tempering heat treatment to compensate the loss of strength and to maximize the effect from the intercritical heat treatment.

The present invention is described in detail as following.

The present invention is for the intercritical heat treatment at 680° C. to 750° C., ferrite-austenite two phase region, for 1 hour to 8 hours between the quenching step and the tempering to improve the impact toughness of SA 508 Gr.3 steels and is for the new tempering conditions to compensate the loss of strength due to the intercritical annealing.

In this invention, the room temperature impact energy of the material is not greatly changed with the intercritical heat treatment at 660° C. to 670° C. However, the impact energy of the material is significantly increased by the intercritical heat treatment at 680° C. to 750° C. for 1 hour to 8 hours.

However, as the intercritical annealing temperature increases up to above 760° C., the impact toughness decreases again to the level similar to that of the conventionally heat treated SA 508 Gr.3 steel Furthermore, the increase in the impact toughness is not observed in the cases that the holding time of intercritical annealing is shorter than about 1 hour or is longer than 8 hours.

Also, this invention states that the ductile-to-brittle transition temperature (DBTT) is decreased by adding the intercritical heat treatment process.

When the SA508 Gr.3 steel is annealed in the intercritical temperature region, the carbides dissolve to carbon and metal atoms and the austenite phase, mostly accicular-shaped, forms from the grain boundaries or lath boundaries at which the carbon content increases fast. The untransformed part of matrix, mostly bainite, becomes tempered banite.

Herein the carbon concentration and hardenability of austenite increases because carbon atoms dissolved from carbides are concentrated into the austenite phase.

The controlled intercritical heat treatments followed by water quenching result in the martensite structure with high dislocation density and fine substructure and, after tempering, give rise to similar profitable effects on the mechanical properties as the effects from the increase of cooling rate.

Meanwhile, when the steel is annealed at an intercritical temperature, the rod-shaped carbides at the lath boundaries of the bainite is coarsened; the matrix become tempered bainite.

When the steel is tempered after the intercritical heat treatment, the matrix, mainly tempered bainite before tempering, becomes double tempered bainite and the martensite becomes tempered martensite consisted of sub-grain structures including relatively high dislocation density.

During tempering the carbides, mostly sphere type, are formed at the boundaries between the martensite having high concentration of alloy elements and tempered bainite or within the martensite.

Impact toughness is largely dependent upon the shape and size of carbides and upon the effective grain size.

As the intercritical heat treatment can produce a composite structure at which relatively strong tempered martensite particles disperse homogeneously on the softer tempered bainite matrix, the effective grain size decrease and consequently the impact toughness increases.

The stress concentration on the spherical carbides is lower than the long rod type carbides. The carbides formed by adding the intercritical heat treatment are more spherical, instead of the plate type carbides after the conventional heat treatment process, and therefore the fracture resistance increases.

In the low temperature region cracking is initiated at the coarse carbides larger than a critical size. The size of carbides can be decreased by reducing the degree of tempering after intercritical heat treatment. The reduced size of carbide retards crack initiation and therefore results in the increase of low temperature toughness.

Meanwhile, the intercritical heat treatment decreases the yield strength and tensile strength of the steel.

However, the decrease in these strengths by the intercritical heat treatment can be compensated by controlling the tempering conditions.

The tempering process is to give toughness in the quenched steels and the strength decreases as the tempering temperature and holding time increase. Accordingly, the present invention includes the modified tempering processes.

With the new tempering process the toughness of the SA 508 Gr. 3 steels can be increased by the intercritical heat treatment without large loss of strength.

According to the invention, the control of tempering temperature not only reduces the decrease of strength but additionally decrease the ductile-to-brittle transition temperature.

Therefore, when the condition for the tempering step is controlled, the decrease of strength caused by the intercritical heat treatment can be minimized and the increase of impact toughness can be maximized.

The present invention is described in detail by the following examples, but which are the embodiments of the invention and not restrict the scope and the boundary of the invention.

EXAMPLE 1

Intercritical Heat Treatment Processes for Manufacturing High Toughness SA 508 Gr 3 Steels The table 1 shows chemical compositions of SA 508 Gr 3 steel used in the invention and specified by the ASME/ASTM specification.

TABLE 1

The chemical compositions of SA 508 Gr. 3 steel

| Element | C | Mn | Si | P | S | Ni | Cr | Mo | Al | Cu | V |
|---|---|---|---|---|---|---|---|---|---|---|---|
| Present Sample | 0.21 | 1.24 | 0.25 | 0.007 | 0.002 | 0.88 | 0.21 | 0.47 | 0.008 | 0.03 | 0.004 |
| ASME/ASTM spec. | max 0.25 | 1.2–1.5 | 0.15–0.40 | max 0.015 | max 0.015 | 0.4–1.0 | max 0.25 | 0.45–0.6 | max 0.04 | max 0.06 | max 0.03 |

Figure 1:
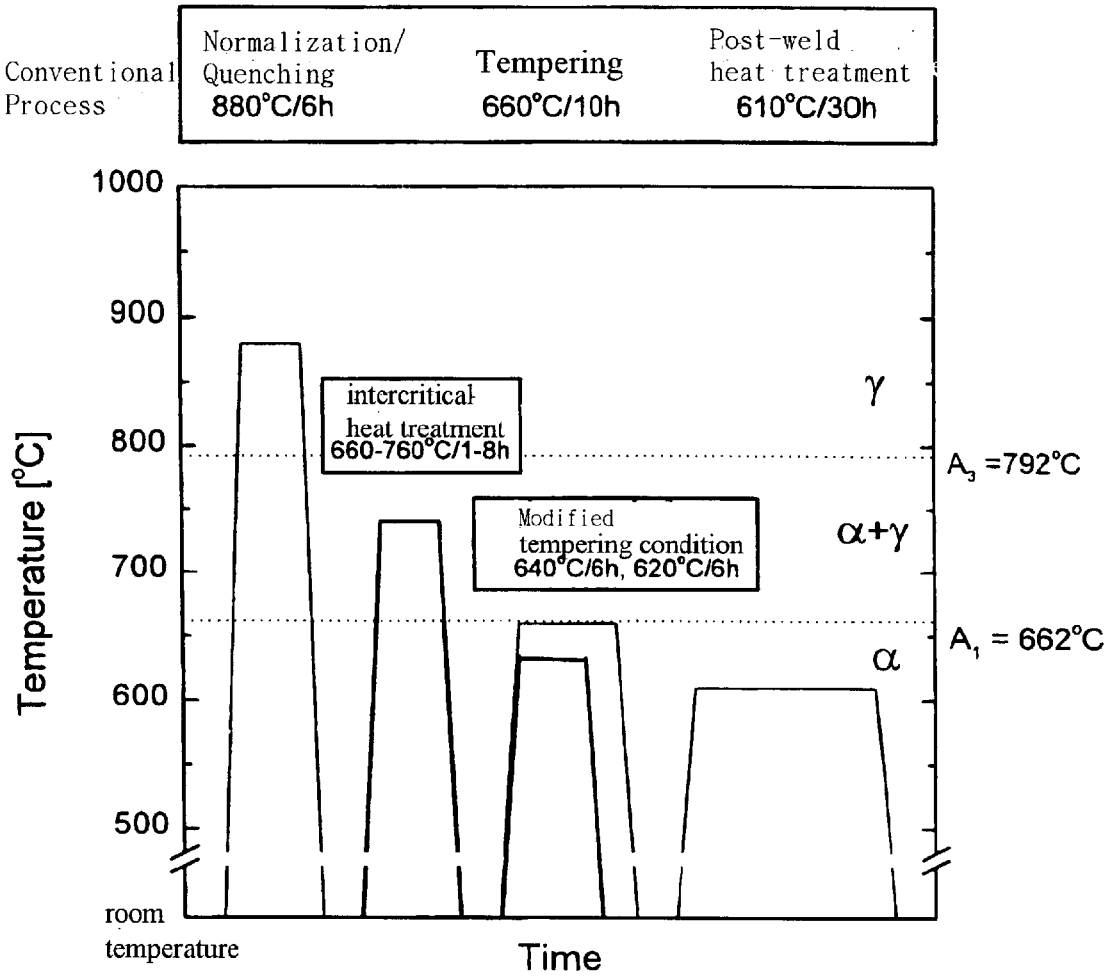
FIG. 1 is the graph showing the heat treatment processes.

The conventional heat treatment process for the SA 508 Gr.3 steels comprises normalizing/quenching, tempering and post-weld heat treatment(PWHT). Thus we performed the heat treatments required in the specification to obtain a reference material; quenching after normalizing at 880° C. for 6 hours, tempering at 660° C. for 10 hours and post-weld heat treatment at 610° C. for 30 hours, as seen in FIG. 1. The intercritical heat treatment was added between the quenching step and the tempering step. Since the increase of toughness depends significantly on the condition of intercritical heat treatment: the intercritical annealing temperature(two phase region), heating rate to the intercritical annealing temperature and holding time, the temperature and holding time in the intercritical heat treatment were varied, but the heating rate was set to be at 0.3° C./minute, which is a similar heating rate to that in the practical manufacturing processes of reactor vessels.

Impact tests of the heat-treated specimens were performed at room temperature to determine the intercritical heat treatment conditions to improve the toughness.

Figure 2:
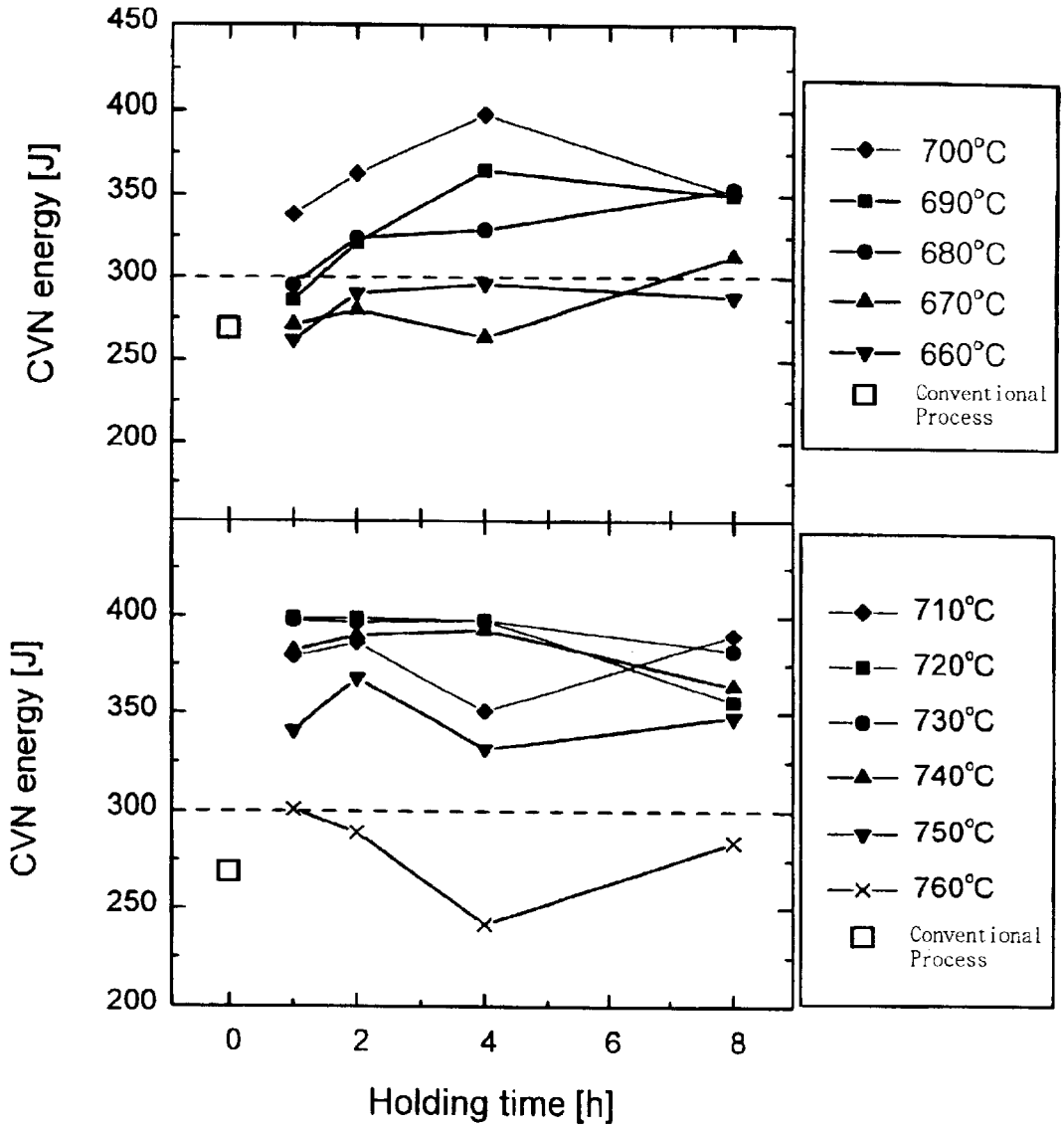
FIG. 2 is the graph showing the variations of room temperature impact energy with the holding time at intercritical temperatures.

FIG. 2 shows the changes of room temperature impact energy values for the two heat treatment processes: the conventional heat treatment and modified heat treatment including intercritical annealing.

The room temperature impact energy of the material made by the conventional process was 269J. When the intercritical heat treatment at 660~670° C. was added between the quenching step and the tempering step, the impact energy did not change greatly.

Otherwise, when the intercritical annealing was performed at 680~690° C. for 2 hours or more, the impact energy greatly increased to 300~400J. Furthermore, when the intercritical annealing was performed at 700~750° C. for over 1 hour, the impact energy increased significantly. However, when the intercritical temperature increased up to 760° C., the toughness became similar to the value from the conventional heat treatment.

Figure 3:
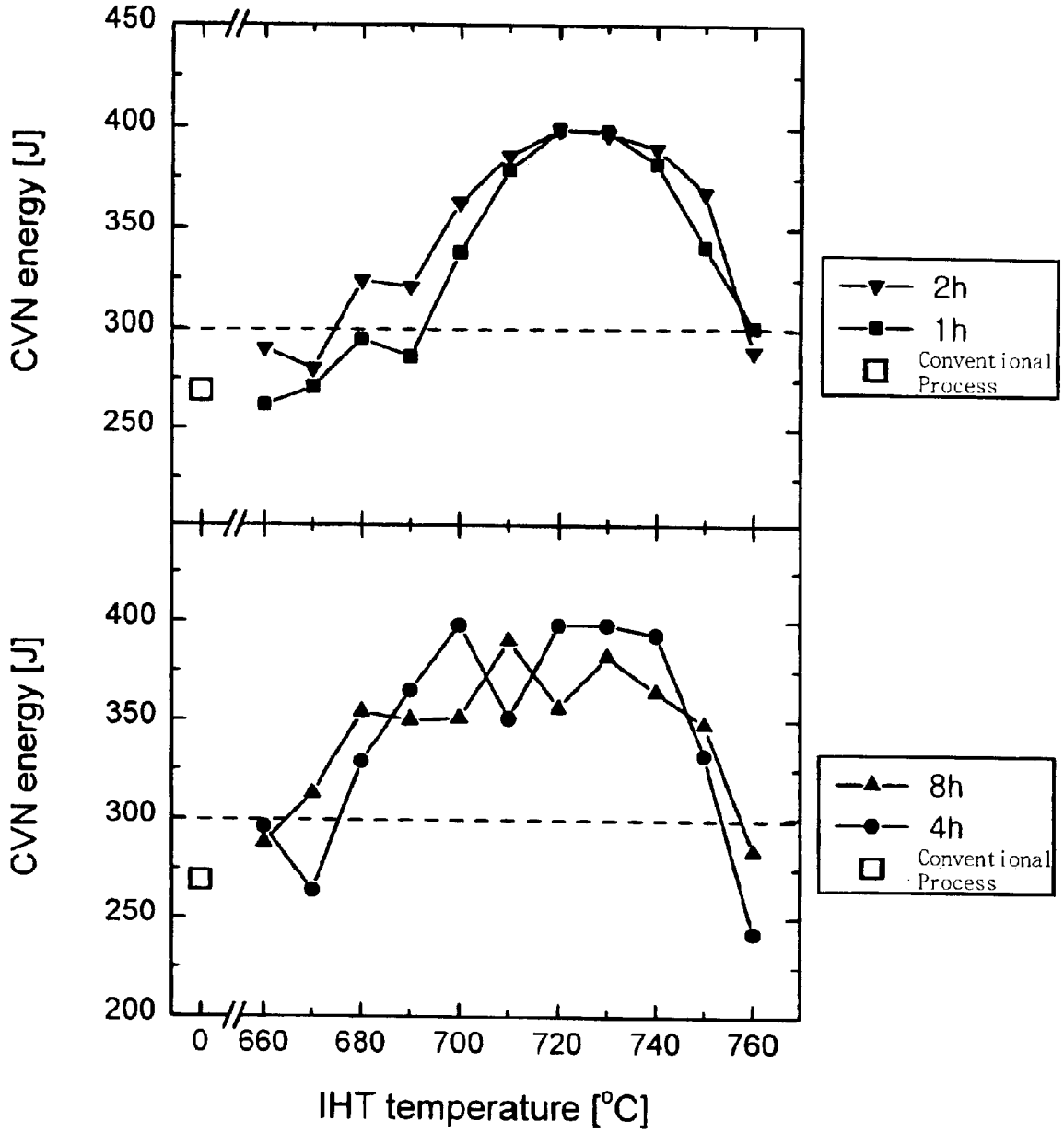
FIG. 3 is the graph showing the variations of room temperature impact energy with the intercritical annealing temperature.

FIG. 3 presents the variations of impact energy with the intercritical annealing temperature. High impact energy values were observed in the cases that the specimens have been annealed in the range of 700~750° C. for 1 hour or in the range of 680~750° C. for 2~8 hours.

Here, we define that the 'conventional process' is the process that is being applied to the current manufacturing practices, which comprises the quenching step(after normalizing at 880° C. for 6 h), the tempering step(660° C./10 h) and post-weld heat treatment step(610° C./30 h), and that 'new process 1' is the heat treatment process including an intercritical heat treatment between the quenching step and the tempering step. Namely, Conventional process=quenching+tempering(660° C./10 h)+post-weld heat treatment New process 1=quenching+intercritical heat treatment+tempering(660° C./10 h)+post-weld heat treatment.

For the above two heat treatment processes, the Charpy impact tests were performed at −90~290° C. to obtain the full toughness-temperature curves and to measure the effect from the intercritical heat treatment.

Figure 4:
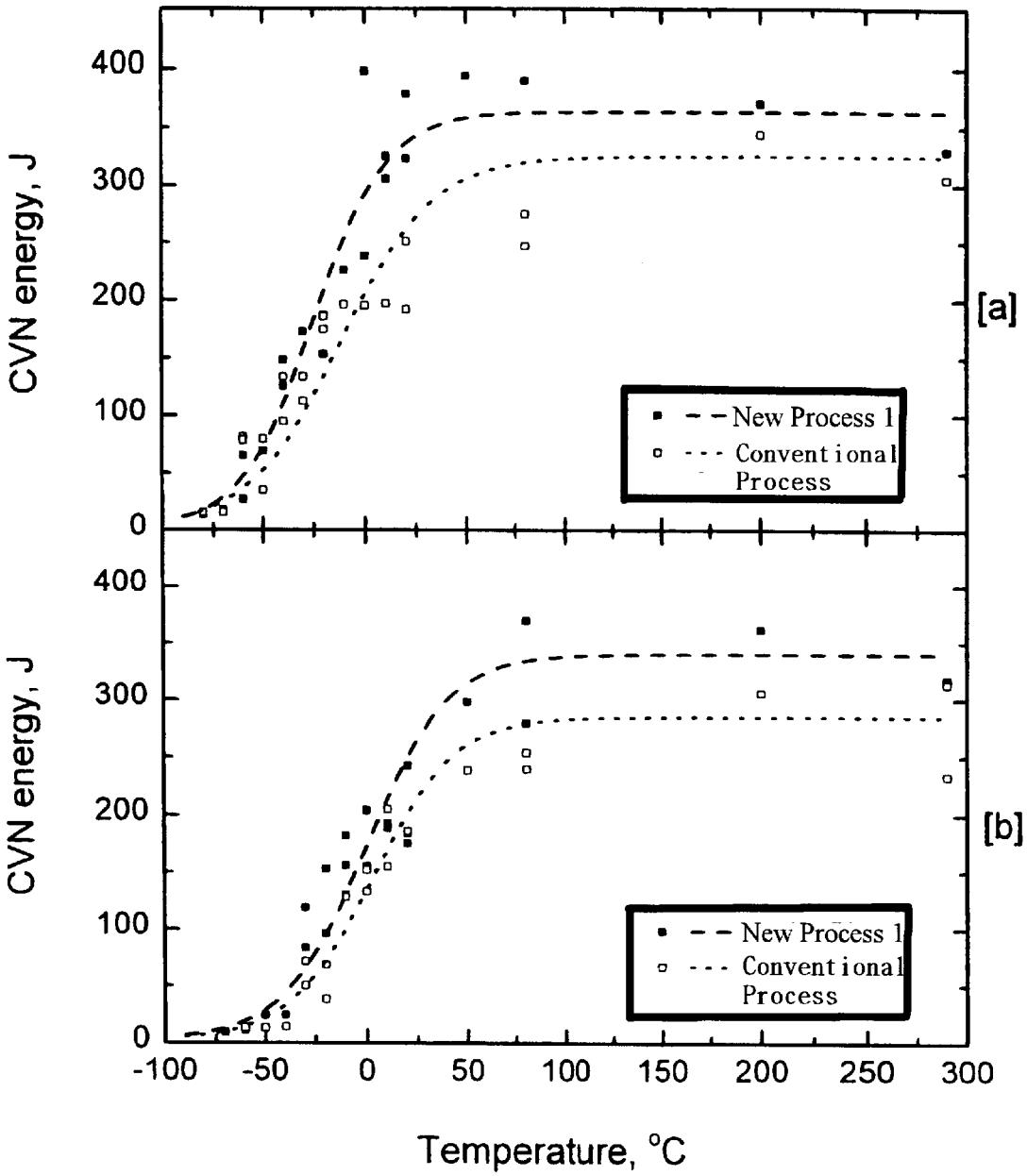
FIG. 4 is the graph showing the transition behaviors of impact energy, wherein [a] is the graph for the case that the cooling rate after the intercritical heat treatment is 100° C./min.

FIG. 4 shows the result of the impact tests at −90~290° C. In the whole test temperature region the impact energy with the 'new process 1' was higher than that with the 'conventional process'.

As shown in table 2, the room temperature impact energy (RTE) and upper shelf energy(USE) increased by 76J(37) and by 47J(15%), respectively, and the transition temperatures, $T_{41J}$ and $T_{68J}$; the temperatures at which the impact energy values are 41J and 68J, respectively, decreased by 7° C. and 8° C., respectively.

TABLE 2

The variations of impact properties by intercritical heat treatment

| | Cooling rate = 100° C./min | | | | Cooling rate = 20° C./min | | | | Average | | | |
|---|---|---|---|---|---|---|---|---|---|---|---|---|
| | $T_{41}$ ° C. | $T_{68}$ ° C. | RTE J | USE J | $T_{41}$ ° C. | $T_{68}$ ° C. | RTE J | USE J | $T_{41}$ ° C. | $T_{68}$ ° C. | RTE J | USE J |
| Conventional process | −57 | −43 | 222 | 325 | −35 | −22 | 185 | 285 | −46 | −33 | 204 | 305 |
| New Process 1 | −63 | −52 | 351 | 363 | −42 | −30 | 209 | 340 | −53 | −41 | 280 | 352 |

In order to observe the effect of intercritical heat treatment on the strength and ductility the tensile tests were performed at room temperature and the result is summarized in table 3.

The elongation(total elongation=Elong.) and reduction of area (RA) with the 'new process 1' increased by about 3.8%(14% to the value for the 'conventional process') and 3.0%(4.26), respectively. The yield strength (YS) and ultimate tensile strength(UTS) decreased by 41 MPa (8.7%), 29 MPa(4.7%), respectively. Here, it is worth noting that the yield and ultimate tensile strengths have enough margins of about 25% and 6%, respectively, to the strength requirements in the ASME/ASTM specification.

TABLE 3

The variations of tensile properties by intercritical heat treatment

| | Cooling rate = 100° C./min | | | | Cooling rate = 20° C./min | | | | Average | | | |
|---|---|---|---|---|---|---|---|---|---|---|---|---|
| | YS MPa | UTS MPa | Elong. % | RA % | YS MPa | UTS MPa | Elong. % | RA % | YS MPa | UTS MPa | Elong. % | RA % |
| Conventional process | 475 | 613 | 26.7 | 72.4 | 468 | 608 | 28.1 | 71.7 | 472 | 611 | 27.4 | 72.1 |
| New Process 1 | 437 | 583 | 32.1 | 75.5 | 424 | 580 | 30.2 | 74.6 | 431 min 345 | 582 550–725 | 31.2 min 18 | 75.1 min 38 |

In order to investigate the cause of the improvement in the impact toughness by intercritical heat treatment, the microstructures of the steel were observed through an optical microscope and a transmission electron microscope.

FIG. 5*a* is the bainite structure of quenched state. FIG. 5*b* is the microstructure of quenched and intercritically heat treated state showing a composite structure of white martensite and black tempered bainite. The white martensite was formed during cooling from the austenite phase formed during the intercritical annealing.

Also, FIGS. 5*c* and 5*d* indicate that, after tempering step, the intercritically heat-treated specimen shows more fine and homogeneous microstructures than the conventionally heat-treated specimen.

FIG. 6*a* is the transmission electron micrograph showing that the grain boundary areas have well-developed dislocation network and fine martensite particles(1 $\mu$m or less in width) with high dislocation density are homogeneously distributed in the tempered bainite matrix having sub-grain structures and low dislocation density.

FIG. 6*b* also shows that small sub-grains with relatively high dislocation density are formed within the tempered bainite composed of relatively crude and large sub-grains having very low dislocation density. The region of small sub-grains is the tempered martensite from fine martensite formed during intercritical annealing.

As for the carbide distribution, in the microstructure with the conventional process, the rod type carbides formed along the lath boundary, relatively crude and large carbides between the laths and needle type carbides precipitated within lath are observed.

In the microstructure with the intercritical heat treatment, however, the carbides were much spheroidized and the inter-particle distance between large rod type carbides was increased.

EXAMPLE 2

Processes for Manufacturing High Toughness SA 508 Gr. 3 Steels with Controlled Tempering Conditions As mentioned above, when the SA 508 Gr. 3 steel is manufactured by the new heat treatment process including the intercritical heat treatment, the impact toughness and ductility of the steel increase, but the strength decreases slightly. The loss of strength by the intercritical heat treatment was compensated by controlling the tempering condition (by lowering the tempering temperature).

ASME/ASTM specification specifies that the tempering treatment should be performed at over 650° C. with holding for 30 minutes or more per one inch thickness.

For the purpose of compensating the strength loss by the intercritical heat treatment, the tempering conditions were changed from 650° C./10 hours to 640° C./6 hours or to 620° C./6 hours, namely 'new process 2' and 'new process 3', respectively, and tensile tests and Charpy impact tests performed for the specimens heat-treated with these new processes. In the case that the post-weld heat treatment is applied, the minimum tempering temperature specified in the ASME/ASTM specification is 635° C. and the highest temperature for the post-weld heat treatment is 620° C. Then the two 'new processes' we tested are New process 2=quenching+intercritical heat treatment+tempering(640° C./6 h)+post-weld heat treatment New process 3=quenching+intercritical heat treatment+tempering(620° C./6 h)+post-weld heat treatment As shown in table 5, if compared to the result of the 'new process 1', the result from the 'new process 2' shows that the yield strength and ultimate tensile strength increase by about 10 MPa, respectively, without large decrease in the ductility (elongation).

Also, FIG. 8 and table 4 shows that as the heat treatment process is changed from the 'new process 1' to the 'new process 2', the room temperature impact energy and the upper shelf energy are almost the same, but the transition temperatures, $T_{41J}$ and $T_{68J}$, decrease by 15° C. and 12° C., respectively.

Furthermore, table 5 also shows that the yield strength and ultimate tensile strength of the 'new process 3' are 30 MPa and 23 MPa higher than those of the 'new process 1', respectively.

Also, the 'new process 2' results in almost the same values of room temperature impact energy and upper shelf energy as those with the 'new process 1'. But the transition temperatures, $T_{41J}$ and $T_{68J}$, decrease by 25° C. and 21° C., respectively These results show that if the tempering condition is controlled properly, the strength decrease due to the intercritical heat treatment can be minimized and the increase of the impact toughness can be maximized.

When the tensile results for the 'new process 3' is compared with those for the 'conventional process', the yield strength and ultimate tensile strength decrease by only 11 MPa(2.3%) and 6 MPa(1%), respectively. However, the total elongation and reduction of area increase by 2.0% (7.3%) and 2.5%(3.5%), respectively. Also, the room temperature impact energy and upper shelf energy increase by 85J (42%) and 35J (12%), respectively, and the transition temperatures, $T_{41J}$ and $T_{68J}$, decrease by 31° C. and 29° C., respectively.

FIG. 9 shows the variations of transition temperatures with respect to the degree of tempering or tempering parameter(TP):

$$TP=T[K]\times(20+\text{Log } t[h])$$

wherein

TP; Tempering Parameter

T; Tempering Temperature t; Tempering time

TABLE 4

The variations of impact properties with respect to tempering conditions.

| | Cooling rate = 100° C./min | | | | Cooling rate = 20° C./min | | | | Average | | | |
|---|---|---|---|---|---|---|---|---|---|---|---|---|
| | $T_{41}$ ° C. | $T_{68}$ ° C. | RTE J | USE J | $T_{41}$ ° C. | $T_{68}$ ° C. | RTE J | USE J | $T_{41}$ ° C. | $T_{68}$ ° C. | RTE J | USE J |
| Conventional process | −57 | −43 | 222 | 325 | −35 | −22 | 185 | 285 | −46 | −33 | 204 | 305 |
| New Process 1 | −63 | −52 | 351 | 363 | −42 | −30 | 209 | 340 | −53 | −41 | 280 | 352 |

TABLE 4-continued

The variations of impact properties with respect to tempering conditions.

| | Cooling rate = 100° C./min | | | | Cooling rate = 20° C./min | | | | Average | | | |
|---|---|---|---|---|---|---|---|---|---|---|---|---|
| | $T_{41}$ ° C. | $T_{68}$ ° C. | RTE J | USE J | $T_{41}$ ° C. | $T_{68}$ ° C. | RTE J | USE J | $T_{41}$ ° C. | $T_{68}$ ° C. | RTE J | USE J |
| New Process 2 | −85 | −69 | 278 | 361 | −50 | −36 | 250 | 355 | −68 | −53 | 264 | 358 |
| New Process 3 | −86 | −73 | 317 | 340 | −69 | −51 | 261 | 340 | −78 | −62 | 289 | 340 |

TABLE 5

The variations of tensile properties with respect to tempering conditions.

| | Cooling rate = 100° C./min | | | | Cooling rate = 20° C./min | | | | Average | | | |
|---|---|---|---|---|---|---|---|---|---|---|---|---|
| | YS MPa | UTS MPa | Elong. % | RA % | YS MPa | UTS MPa | Elong. % | RA % | YS MPa | UTS MPa | Elong. % | RA % |
| Conventional process | 475 | 613 | 26.7 | 72.4 | 468 | 608 | 28.1 | 71.7 | 472 | 611 | 27.4 | 72.1 |
| New Process 1 | 437 | 583 | 32.1 | 75.5 | 424 | 580 | 30.2 | 74.6 | 431 | 582 | 31.2 | 75.1 |
| New Process 2 | 450 | 596 | 30.1 | 74.7 | 432 | 588 | 29.4 | 72.6 | 441 | 592 | 29.8 | 73.7 |
| New Process 3 | 465 | 606 | 29.5 | 74.6 | 457 | 604 | 29.3 | 74.6 | 461 | 605 | 29.4 | 74.6 |
| ASME/ASTM | | | | | | | | | min 345 | 550–725 | min 18 | min 38 |

What is claimed is:

1. A heat treatment process for manufacturing high toughness SA 508 Gr. 3 steels which comprises the steps of quenching and tempering, the improvement comprising adding a step of intercritical heat treatment between the quenching and tempering steps, wherein the intercritical heat treatment comprises a annealing at 680° C. to 750° C. for 1 hour to 8 hours.

2. A process for manufacturing high toughness SA 508 Gr. 3 steels according to claim 1, wherein the tempering after the intercritical heat treatment is performed at the temperature lower than 635° C.

3. A process according to claim 1, comprising the additional steps of normalizing before the quenching step, and post-weld heat treatment after the tempering step.

4. The process of claim 3, comprising the additional step of quenching after the intercritical heat treatment step.

5. The process of claim 1, comprising the additional step of quenching after the intercritical heat treatment step.

6. The process of claim 4, comprising the additional step of quenching after the tempering step.

7. The process of claim 1, comprising the additional step of quenching after the tempering step.

8. The process of claim 3, wherein the tempering step after the intercritical heat treatment step is performed at a temperature lower than 635° C.

9. The process of claim 1, comprising the additional step of compensating for loss of strength caused by the intercritical heat treatment step by the step of controlling the tempering by lowering the tempering temperature.

10. The process of claim 3, comprising the additional step of compensating for loss of strength caused by the intercritical heat treatment step by the step of controlling the tempering by lowering the tempering temperature.

11. The process of claim 2, whereby room temperature impact energy of the steel is significantly increased and ductile-to-brittle transition temperature is decreased.

12. The process of claim 8, whereby room temperature impact energy of the steel is significantly increased and ductile-to-brittle transition temperature is decreased.

13. The process of claim 1, wherein carbides dissolve to carbon and metal atoms, austenite phase forms from grain boundaries at which carbon content rapidly increases, untransformed bainite becomes tempered with carbides concentrated in the austenite phase and rod-shaped carbides at the boundaries are coarsened, by the intercritical heat treatment, and during the tempering, the tempered bainite becomes double tempered, martensite becomes tempered and mostly spherical carbides are formed at boundaries between the martensite and tempered bainite or within the martensite.

14. The process of claim 3, wherein carbides dissolve to carbon and metal atoms, austenite phase forms from grain boundaries at which carbon content rapidly increases, untransformed bainite becomes tempered with carbides concentrated in the austenite phase and rod-shaped carbides at the boundaries are coarsened, by the intercritical heat treatment, and during the tempering, the tempered bainite becomes double tempered, martensite becomes tempered and mostly spherical carbides are formed at boundaries between the martensite and tempered bainite or within the martensite.

15. The process of claim 2, wherein carbides dissolve to carbon and metal atoms, austenite phase forms from grain boundaries at which carbon content rapidly increases, untransformed bainite becomes tempered with carbides concentrated in the austenite phase and rod-shaped carbides at the boundaries are coarsened, by the intercritical heat treatment, and during the tempering, the tempered bainite becomes double tempered, martensite becomes tempered and mostly spherical carbides are formed at boundaries between the martensite and tempered bainite or within the martensite.

16. The process of claim 5, wherein carbides dissolve to carbon and metal atoms, austenite phase forms from grain boundaries at which carbon content rapidly increases, untransformed bainite becomes tempered with carbides concentrated in the austenite phase and rod-shaped carbides at the boundaries are coarsened, by the intercritical heat treatment, and during the tempering, the tempered bainite becomes double tempered, martensite becomes tempered and mostly spherical carbides are formed at boundaries between the martensite and tempered bainite or within the martensite.

* * * * *